US006484748B1

(12) United States Patent
Baker

(10) Patent No.: US 6,484,748 B1
(45) Date of Patent: Nov. 26, 2002

(54) WATER PEDESTAL

(76) Inventor: Anthony Baker, P.O. Box 280, Monroe, OR (US) 97456

( * ) Notice: Subject to any disclaimer, the term of this patent is extended or adjusted under 35 U.S.C. 154(b) by 0 days.

(21) Appl. No.: 09/866,075

(22) Filed: May 24, 2001

(51) Int. Cl.[7] ..... F16L 5/00

(52) U.S. Cl. ..... 137/363; 137/364; 137/377; 137/382

(58) Field of Search ..... 137/363, 364, 137/371, 377, 382, 294

(56) References Cited

U.S. PATENT DOCUMENTS 4,133,021 A * 1/1979 King et al. ..... 361/365
4,519,657 A 5/1985 Jensen
4,556,080 A * 12/1985 Picaud ..... 137/377 X
4,785,376 A 11/1988 Dively
4,951,182 A 8/1990 Simonson et al.
5,184,279 A 2/1993 Horn
6,021,804 A * 2/2000 Griffin et al. ..... 137/377 X
6,247,490 B1 * 6/2001 Mosher et al. ..... 137/363

* cited by examiner

*Primary Examiner*—Kevin Lee
(74) *Attorney, Agent, or Firm*—Robert E. Howard

(57) ABSTRACT

A water pedestal for supplying water to a recreational vehicle. The water pedestal includes a housing having a tubular wall, an open lower end and an open upper end. A flexible conduit is located substantially within the housing, the flexible conduit having a lower end extending below said open lower end of said housing and adapted to be attached to an underground water main. The flexible conduit has an upper end attached to a ball valve. The flexible conduit is formed into a loop between the upper and lower ends thereof. A rigid conduit communicate the ball valve with an anti-syphon hose bib. The hose bib includes a rigid pipe and a faucet attached to the outer end of the rigid pipe, the rigid pipe extending through the wall of the water pedestal housing adjacent the upper end of the housing. A tubular slip sleeve is located within the housing and attached to the tubular wall of the housing at a mid-portion thereof. The tubular slip sleeve is positioned around the loop of flexible conduit and holds it in place within the housing. A cap is removably attached to the open upper end of the housing.

15 Claims, 2 Drawing Sheets

Fig. 1
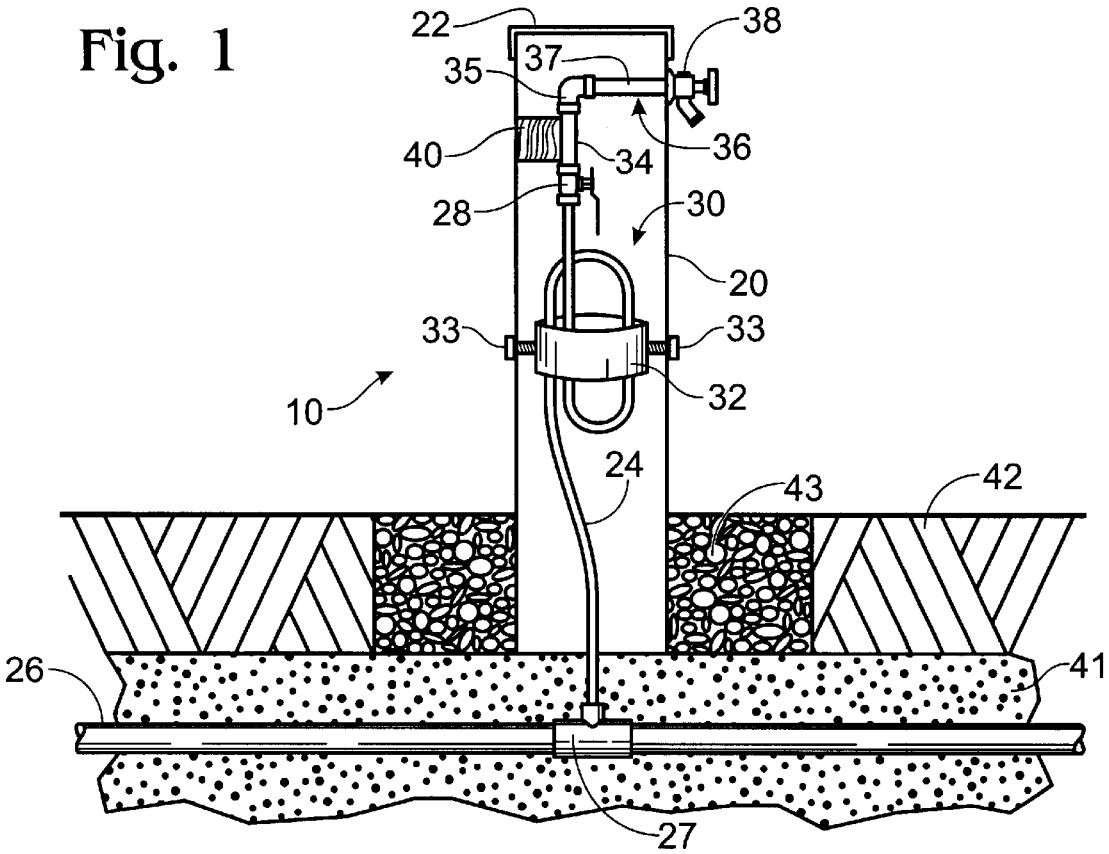
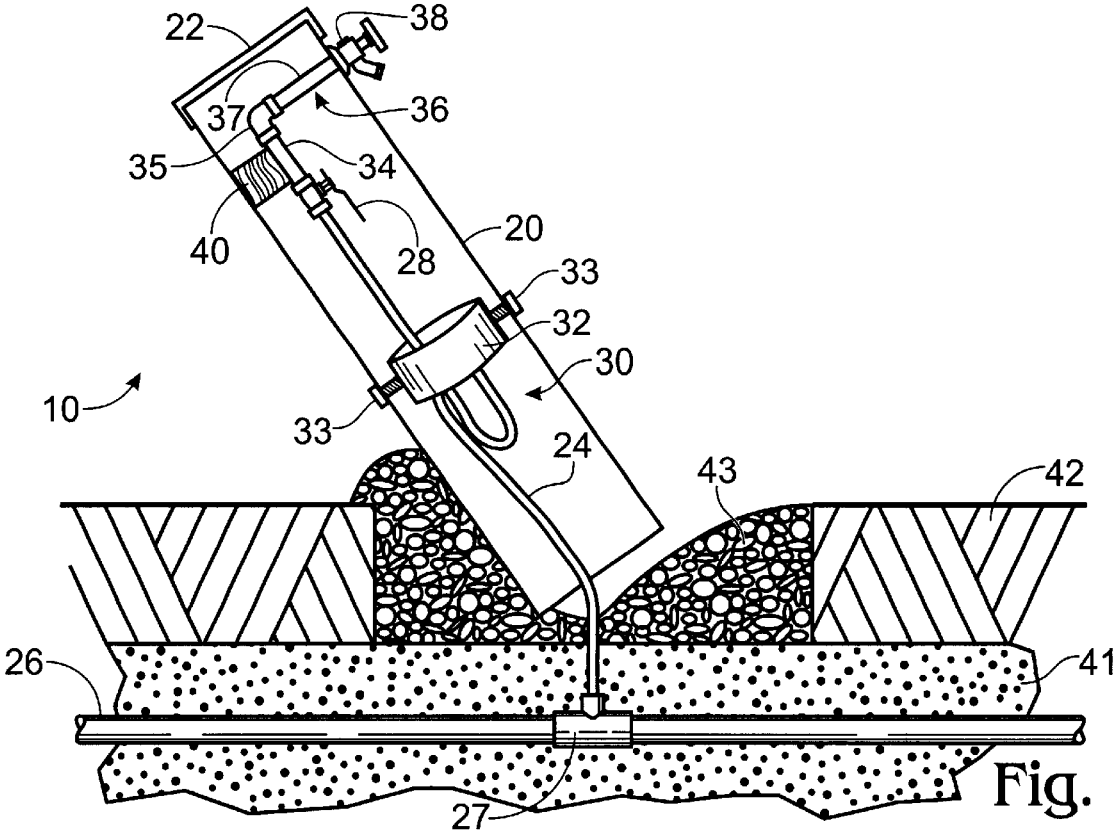
Fig. 3

WATER PEDESTAL

BACKGROUND OF THE INVENTION

This invention relates to a water pedestal for providing a water hookup for recreational vehicles that is resistant to damage from accidental collisions.

Many RV parks provide a water hookup that is a faucet or hose bib located below ground level. Such below ground level installations can fill with water or contain insects or small reptiles, and require the user to get down on his or her hands and knees to attach a hose.

Where above ground level installations are used, they typically are merely pipes extending upwardly from the underground water main with a faucet on the upper end. In parking recreational vehicles it is not uncommon for the driver to inadvertently bump into such a pipe and cause a rupture between the pipe and the water main. The rupture causes minor flooding and requires the services of a plumber to fix.

SUMMARY OF THE PRESENT INVENTION

It is an object of the present invention to provide a water pedestal that provides a water hookup that is easier to access and which can sustain low speed impacts without rupturing the connection to the water main.

This and other objects are achieved by a water pedestal that includes a housing having a tubular wall, an open lower end and an open upper end.

A flexible conduit is located substantially within the housing, the, flexible conduit having a lower end extending below the open lower end of the housing and adapted to be attached to an underground water main.

The flexible conduit has an upper end attached to a ball valve. Rigid conduit means communicate the ball valve with an anti-syphon hose bib. The hose bib includes a rigid pipe and a faucet attached to the outer end of the rigid pipe, the rigid pipe extending through the wall of the water pedestal housing adjacent the upper end of the housing.

The flexible conduit has a length that is about twice the distance between its connection to the underground water main and the ball, valve. This excess length allows a loop to be formed between the lower and upper ends thereof.

A slip sleeve is located within the housing and attached to the tubular wall of the housing at a mid-portion thereof. The loop of the flexible conduit is placed within the slip sleeve and held in place therein.

A cap is removably attached to the open upper end of the housing.

In use the lower end of the housing is surrounded by a non-packing filler material, such as round rock having a diameter between about 0.25 inch and about 2.0 inches. In the event the water pedestal is struck at a low speed by a recreational vehicle, the housing will tilt backwards within the non-packing filler material, and the resulting force acting on the flexible conduit will cause part of the excess length thereof contained in the loop to be pulled downwardly, thereby preventing a rupture at the connection between the flexible conduit and the water main.

BRIEF DESCRIPTION OF THE DRAWINGS

FIG. 1 is a side elevation view of the water pedestal system of the present invention, in its operational mode;

FIG. 3 is an enlarged side elevation view of the water pedestal of the present invention shown in its partially knocked over position.

DESCRIPTION OF PREFERRED EMBODIMENTS

Figure 2:
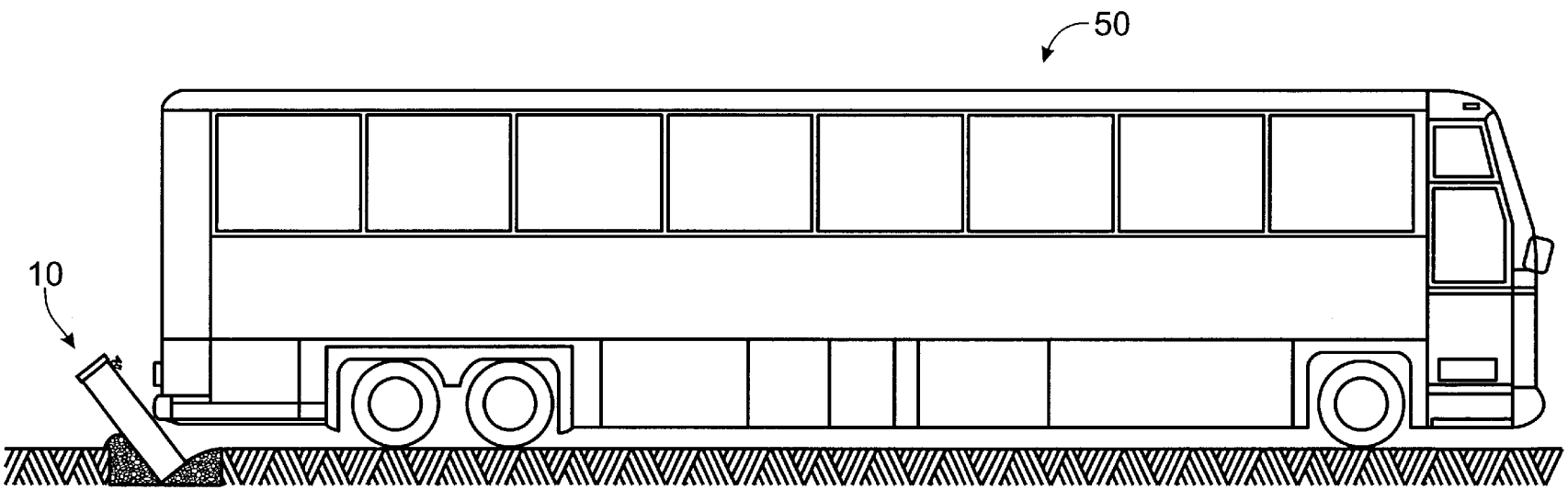
FIG. 2 is a side elevation view of the water pedestal of the present invention shown after having been partially knocked over by a recreational vehicle.

The water pedestal 10 of the present invention includes a housing 20 having a tubular wall. Housing 20 is preferably cylindrical in shape. However, housing 20 may be other tubular shapes, such as one having a rectangular or square cross-section.

Housing 20 is open at both ends and has a cap 22 removably attached to its upper end. Housing 20 and cap 22 may be made of any weather resistant material, such as PVC (polyvinyl chloride).

Inside water pedestal housing 20 is a flexible water conduit 24 which is adapted to be attached at its lower end to underground water main 26 via attachment fitting 27, and attached at its upper end to the inlet side of ball valve 28.

Flexible water conduit 24 has a length that is about twice the distance between its connection at fitting 27 to underground water main 26 and its connection to ball valve 28, as shown in FIG. 1. The excess length of flexible conduit 24 is gathered into a loop 30 between its upper and lower ends, substantially at its mid-section.

Loop 30 is held in place within housing 20 by tubular slip sleeve 3.2. Slip sleeve 32 is preferably a cylinder that has a diameter that is smaller (e.g., a diameter of about 8 inches) than the diameter of housing 20 (e.g., a diameter of about 12 inches). Slip sleeve 32 is centrally located within housing 20 at approximately the mid-point between the upper and lower ends of housing 20, slip sleeve 32 and housing 20 being substantially coaxial. Slip sleeve 20 is held in place by any suitable means attached to housing 20, such as bolts 33 passing through the walls of housing 20 and slip sleeve 33, bolts 33 having washers and nuts (not shown) attached to the inner ends of bolts 33. Preferably there are two bolts 33, and they are diametrically opposed.

The outlet side of ball valve 28 is connected to the lower end of rigid nipple 34. The upper end of nipple 34 is attached to rigid elbow 35.

An anti-syphon hose bib 36 is attached to elbow 35. Hose bib 36 includes a rigid pipe section 37 with a faucet 38 attached to its outer end. Rigid pipe section 37 passes through the wall of housing 20 adjacent its upper end with faucet 38 being located outside housing 20.

The height of faucet 38 above the ground is selected to be user friendly and clean, i.e., at a height which can vary from about 12 inches to about 32 inches above the ground. Such a height requires little or no bending for a person of average height.

The outer face of a spacer member 40 is attached to the inner wall of pedestal housing 20 by any suitable attachment means, such as screws (not shown). Nipple 34 is attached to the inner face of spacer member 40 by any suitable means, such as conventional U-shaped pipe stabilizer braces, not shown. Spacer member 40 can be made of any suitable material, but wood is preferred since it readily accepts screws.

Water pedestal 10 will typically be installed at the time water main 26 is laid out in the RV park. Flexible conduit attachment fittings 27 are installed at appropriate locations along the water main 26, only one of which is shown in FIGS. 1 and 3. Flexible conduit 24 is attached to attachment fitting 27 vertically, as shown, and the system tested for leaks. The water main 26 is covered with a suitable back fill material 41 to a sub grade height that is about twelve inches below the top of finish grade material 42.

Water pedestal housing 20 is positioned on top of the sub grade with flexible conduit 24 substantially centered, as shown in FIG. 1. A non-packing filler material 43, such as round rock having a diameter between about 0.25 inch and about 2.0 inches, is then placed around water pedestal housing 20 for a surrounding distance of about one foot and to a depth that is substantially the same as the depth of finish grade material 42, i.e., about one foot.

If necessary, cap 22 is removed and loop 30 is expanded to take up any slack in the lower portion of flexible conduit 24. Cap 22 is then replaced.

The foregoing is a description of the installation of a water pedestal 10 that is substantially pre-assembled. If water pedestal 10 is not pre-assembled, it can be assembled on site by first attaching flexible conduit 24 to flexible conduit attachment fitting 27, and then attaching ball valve 28, nipple 34, hose bib 36 and faucet 38 together in a leak-proof manner, checking for leaks along the way. Slip sleeve 32 is attached to the housing 20, such as by nuts and bolts. The housing 20 and slip sleeve 32 is then arranged over hose bib 36, elbow 35, nipple 34, ball valve 28 and flexible conduit 24. A loop 30 is formed above the slip sleeve 32 and inserted into slip sleeve 32, making adjustments in loop 30 to take up any slack in the upper or lower portions of flexible conduit 24. Cap 22 is then placed on the top of housing 20.

In colder climates, it is desirable that insulation be placed inside housing 20 and around the various water carrying parts. For example, packing peanuts could be dumped into housing 20.

FIG. 2 shows a recreational vehicle 50 that has bumped into water pedestal 10. Upon impact, typically at a very slow backing up speed, housing 20 tilts backward in the non-packing material 43, as best seen in the enlarged view shown in FIG. 3. Flexible conduit 24, being attached at its inner end to flexible conduit attachment fitting 27, would normally be pulled away from attachment fitting 27, rupturing the connection. However, the force of the impact acting against housing 20 and flexible conduit 24 causes flexible conduit 24 to pull out some of the excess flexible conduit contained in loop 30, thereby preventing rupturing forces from developing at the point where the flexible conduit 24 is attached to attachment fitting 27.

Repair consists of merely removing the non-packing material 43, standing water pedestal 10 back up in the vertical position shown in FIG. 1, removing cap 22, pulling up excess flexible conduit 24 into loop 30, and replacing non-packing material 43 and cap 22.

While the invention has been described relative to a pedestal for providing a water hookup for recreational vehicles, the pedestal may also include an electric power hookup, a telephone line hookup, a compressed air outlet, etc.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A water pedestal comprising:

a housing having a tubular wall and open lower and upper ends;

a flexible conduit located within said housing, said flexible conduit having a lower end extending below said open lower end of said housing, said lower end of said flexible conduit being adapted to be attached to an underground water main, said upper end of said flexible conduit being attached to a ball valve, said flexible conduit being formed into a loop between said upper and lower ends thereof;

a rigid conduit communicating said ball valve with an anti-syphon hose bib, said anti-syphon hose bib including a rigid pipe having inner and outer ends and a faucet attached to said outer end of said rigid pipe, said rigid pipe of said anti-syphon hose bib extending through the tubular wall of said housing adjacent the upper end of said housing;

a tubular slip sleeve located within said housing and attached to said tubular wall of said housing at a mid-portion thereof;

said slip sleeve being positioned around said loop in said flexible conduit to thereby hold said loop in place within said housing; and a cap removably attached to said open upper end of said housing.

2. The water pedestal of claim 1 wherein said housing has a cylindrical wall.

3. The water pedestal of claim 1 wherein said slip sleeve is cylindrical.

4. The water pedestal of claim 1 wherein said flexible conduit has a length that is about twice the distance between said water main and said ball valve.

5. The water pedestal of claim 1 wherein said rigid conduit means includes a nipple having a lower end attached to said ball valve and an upper end attached to an elbow.

6. The water pedestal of claim 5 including a spacer member having inner and outer faces, said spacer member being located between said nipple and said tubular wall of said housing, the outer face of said spacer member being attached to said tubular wall of said housing and the inner face of said spacer member being attached to said nipple.

7. A water pedestal system comprising:

a housing having a tubular wall and open lower and upper ends, said open lower end being positioned above an underground water main and surrounded by a non-packing filler material;

a flexible conduit located within said housing, said flexible conduit having a lower end extending below said open lower end of said housing, said lower end of said flexible conduit being attached to said underground water main, said upper end of said flexible conduit being attached to a ball valve, said flexible conduit being formed into a loop between said lower and upper ends thereof;

a rigid conduit communicating said ball valve with an anti-syphon hose bib, said anti-syphon hose bib including a rigid pipe having inner and outer ends and a faucet attached to said outer end of said rigid pipe, said rigid pipe of said anti-syphon hose bib extending through the tubular wall of said housing adjacent the upper end of said housing;

a tubular slip sleeve located within said housing and attached to said tubular wall of said housing at a mid-portion thereof;

said slip sleeve being positioned around said loop in said flexible conduit to thereby hold said loop in place within said housing; and a cap removably attached to said open upper end of said housing.

8. The water pedestal system of claim 7 wherein said housing has a cylindrical wall.

9. The water pedestal system of claim 7 wherein said slip sleeve is cylindrical.

10. The water pedestal system of claim 7 wherein said flexible conduit has a length that is about twice the distance between said water main and said ball valve.

11. The water pedestal system of claim 7 wherein said non-packing filler material is round rock having a diameter of between about 0.25 inch and about 2.0 inches.

12. The water pedestal system of claim 7 wherein said non-packing filler material has a depth of about one foot.

13. The water pedestal system of claim 7 wherein said faucet is positioned a distance above ground level which permits a user to attach a hose thereto without any substantial bending.

14. The water pedestal of claim 7 wherein said rigid conduit means includes a nipple having a lower end attached to said ball valve and an upper end attached to an elbow.

15. The water pedestal of claim 14 including a spacer member having inner and outer faces, said spacer member being located between said nipple and said tubular wall of said housing, the outer face of said spacer member being attached to said tubular wall of said housing and the inner face of said spacer member being attached to said nipple.

* * * * *